US005259499A

United States Patent [19]

Boettger

[11] Patent Number: 5,259,499

[45] Date of Patent: Nov. 9, 1993

[54] SYSTEM AND APPARATUS FOR ACCURATE DRUG INVENTORY CONTROL

[75] Inventor: Conrad H. Boettger, Hesston, Kans.

[73] Assignee: St. Francis Research Institute, Wichita, Kans.

[21] Appl. No.: 989,545

[22] Filed: Dec. 10, 1992

[51] Int. Cl.[5] ..... B65D 85/58; A61J 1/00

[52] U.S. Cl. ..... 206/232; 206/534; 206/539; 383/37

[58] Field of Search ..... 206/232, 459.5, 528, 206/531, 532, 534, 538, 539, 820; 383/37, 38

[56] References Cited

U.S. PATENT DOCUMENTS

| | | | |
|---|---|---|---|
| 3,347,358 | 10/1967 | Meyers | 206/459.5 |
| 3,621,992 | 11/1971 | Osborne et al. | 206/539 |
| 3,931,885 | 1/1976 | Nahill et al. | 206/538 |
| 4,189,053 | 2/1980 | Stagnitto et al. | 206/531 |
| 4,673,086 | 6/1987 | Braverman et al. | 206/538 |
| 4,811,845 | 3/1989 | Baggett | 206/534 |
| 4,889,238 | 12/1989 | Batchelor | 206/232 |
| 4,972,657 | 11/1990 | McKee | 206/534 |

*Primary Examiner*—Jimmy G. Foster

*Attorney, Agent, or Firm*—Hovey, Williams Timmons & Collins

[57] ABSTRACT

An improved method and apparatus designed to facilitate the dispensing and inventory control of medications is provided, preferably in the form of a book (16) containing a plurality of transparent bags (10–14). Each of the bags (10–14) holds one or more multiple-dosage cards (32–36) including a plurlaity of transparent, frangible, single dosage form-holding compartments (38). Each bag is moreover provided with medication and dosage form information (25), preferably along a side marginal edge thereof. A record sheet (52) is also provided which includes reference markings (54) for each of the medications and dosage forms contained within a respective bag (10–14), along with spaces (56) for noting periodic usage of each dosage form of each different medication. Periodic inventory control is accomplished by counting the individual dosage forms of each medication through the outer transparent bags (10–14) and the compartments (38), and correlating the counted number of each dosage form of each medication with the inventory control record 52.

4 Claims, 1 Drawing Sheet

SYSTEM AND APPARATUS FOR ACCURATE DRUG INVENTORY CONTROL

BACKGROUND OF THE INVENTION

1. Field of the Invention

The present invention is broadly concerned with an improved method and apparatus for facilitating the dispensing and maintenance of inventory control for a plurality of different medications in individual dosage forms (e.g., tablets or capsules). More particularly, it is concerned with such a method and apparatus which makes use of individual selectively openable bags each holding one or more medication cards; the bags include a transparent viewing panel, whereas the cards have a plurality of frangible, substantially transparent single dosage form-holding compartments. In use, as a particular medication is needed, the corresponding bag is opened, and the desired number of individual dosage forms is removed from the multiple-dosage card. A notation is made of the medication removed on a control record, the card is returned to the bag, and the latter is resealed. Inventory control is accomplished by periodically counting the individual dosage forms of each medication by viewing through the corresponding bag and the single dosage compartments of the card(s) therein, and correlating this count with the notations on the inventory control record.

2. Description of the Prior Art

In many health care settings, narcotics, analgesics and other medications are provided in single dosage forms used for the alleviation of pain. Many of these are controlled substances and must be carefully accounted for in order to eliminate theft and drug abuse. Accordingly, all health care institutions should have an accounting system in place for the monitoring of use or wastage of controlled medications. Such systems typically require, as a part of each nursing shift routine, that the medications be counted by two members of the professional staff, one from each of the offgoing and oncoming shift. This count insures that the beginning and ending shift total accurately reflect the amount and type of medications used during the course of the shift. In a typical oncology hospital unit, 40–50 different types and dosages of controlled medications must be counted three times in each 24 hour period, 365 days per year. As can be appreciated, this represents a significant time factor.

Orally administered tablets and capsules are normally packaged on flat, rigid, multiple-dosage cards presenting a number of frangible, substantially transparent, single dosage compartments. As the medication is needed, it is necessary to break the necessary number of compartments to remove the tablets or capsules from the card. At the same time, a record is kept of medication and dosage form usage on a shift drug record. It has been found that over time the individual dosage form compartments can become separated from the card, leaving them loose and easily misplaced. This results in increased nursing time spent looking and accounting for all used and unused dosages.

There is accordingly a real and unsatisfied need in the art for an improved method and apparatus designed to facilitate the dispensing and periodic inventory control of medications.

SUMMARY OF THE INVENTION

The present invention overcomes the problems outlined above, and provides a medication control method and apparatus in the form of a plurality of selectively openable bags, each presenting a transparent viewing panel, with each bag holding one or more multiple-dosage cards of the type having a plurality of frangible, substantially transparent, single dosage form-holding compartments therein. Means is provided for releasably interconnecting a plurality of card-holding bags along a common margin thereof, in order to facilitate quick visual counting of the individual dosage forms within each bag. An inventory control record sheet is also provided which includes markings thereon referencing each of the dosage forms of the different medications contained within respective bags, and with spaces associated with each medication/dosage form reference for noting the periodic usage thereof.

Preferably, each of the bags is formed of interconnected, transparent front and rear panels, and includes indicia-bearing means for marking of each bag with individual dosage form and medication information corresponding to the medication and dosage form contained within the bag.

Advantageously, the plural dosage bags are interconnected along a side marginal edge to present a book-like structure wherein each of the bags can be individually viewed for counting purposes.

DETAILED DESCRIPTION OF THE PREFERRED EMBODIMENTS

Figure 1:
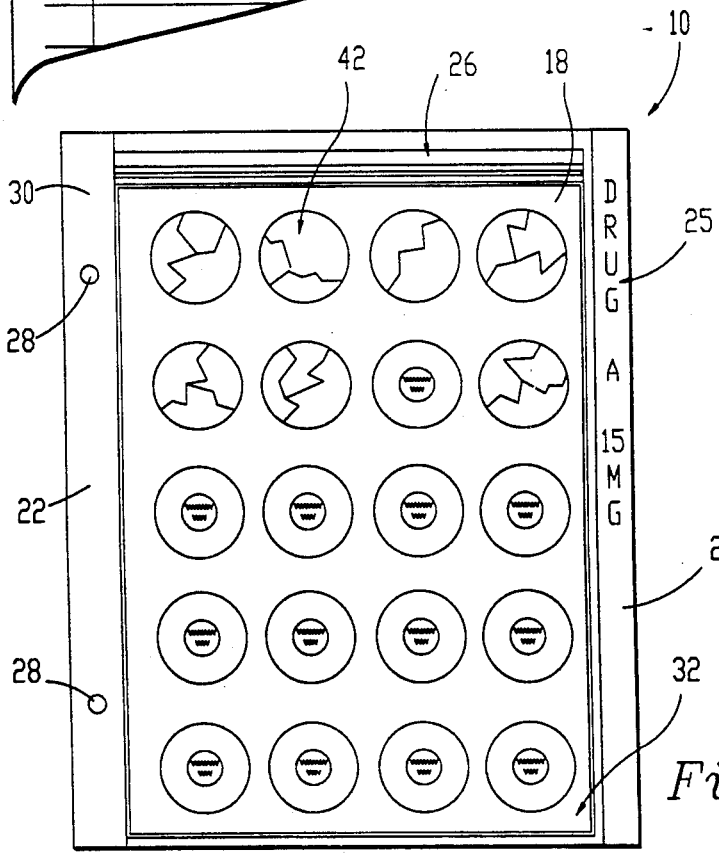
FIG. 1 is a front elevational view of a medication bag in accordance with the invention, shown with a multiple-dosage card therein.

Turning now to the drawing, and particularly FIG. 1, a medication bag 10 is illustrated. The bag 10 is designed to be used in conjunction with a number of other identical bags, e.g., bags 12 and 14 (see FIG. 2), to form a multiple bag book 16.

In more detail, each of the bags 10–14 is formed of synthetic resin material and includes a transparent front panel 18, a transparent rear panel 20, a reinforced, apertured inner side margin 22, an indicia-bearing outer side margin 24, and releasable locking mechanism 26 across the open top of the bag. Again referring to FIG. 2, it will be observed that the inner margin 22 includes a pair of spaced apart binding apertures 28 thereto, with the margin being reinforced by provision of a central strip 30 between the front and rear panels 18, 20. The outer margin 24 may include a label or be designed to permit marking thereon of medication and dosage information 25. In the embodiment illustrated, it will be seen that the words "Drug A 15 MG" are applied to the outer margin 24. This of course indicates that the bag in question is designed to hold "Drug A" in individual dosage forms of 15 mg each.

The locking mechanism 26 may be of any convenient construction, but is preferably of the well-known zipper-type exemplified by the commercially available "ZIP-LOC" bags. Those skilled in the art will appreciate that this type of locking mechanism allows the bag to be repeatedly opened and closed without damage to the bag.

Figure 3:
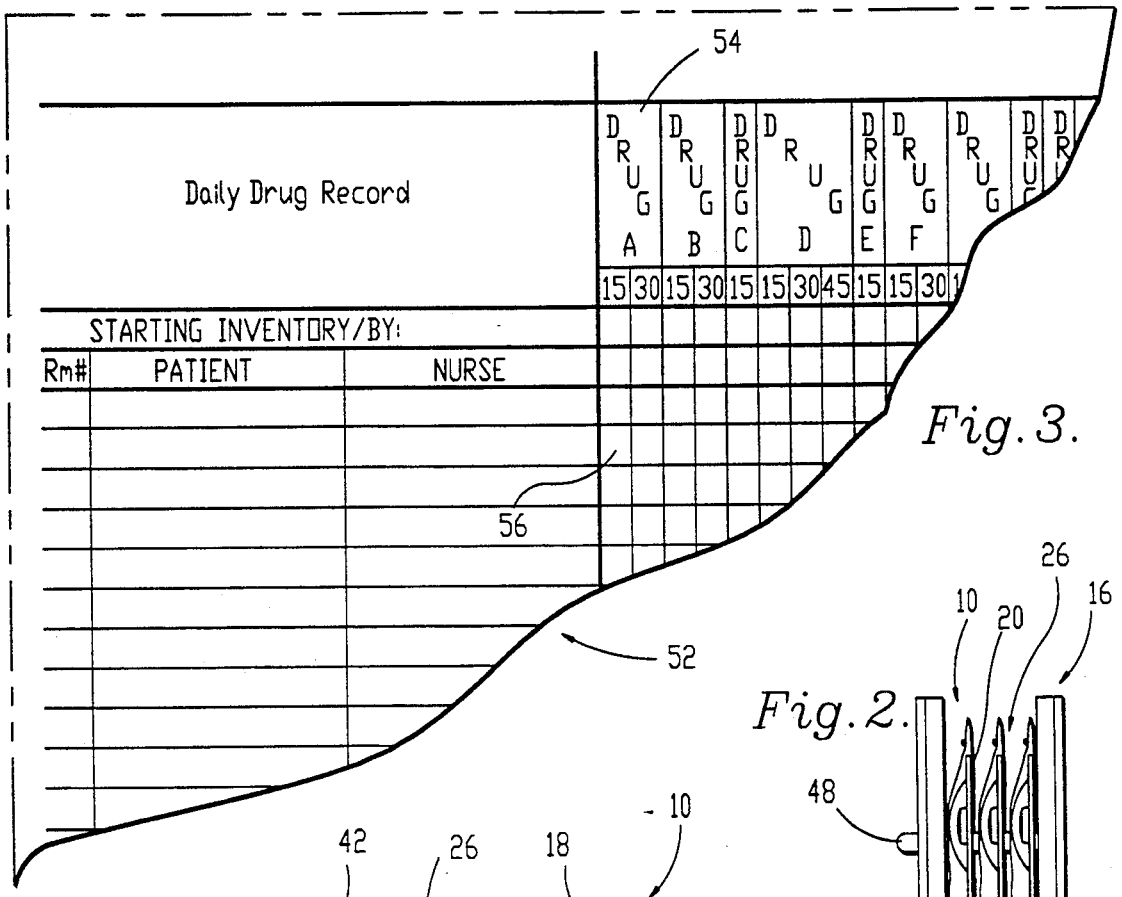
FIG. 3 is a fragmentary view of an inventory control record sheet usable with the multiple bag medication book of FIG. 2.
Figure 2:
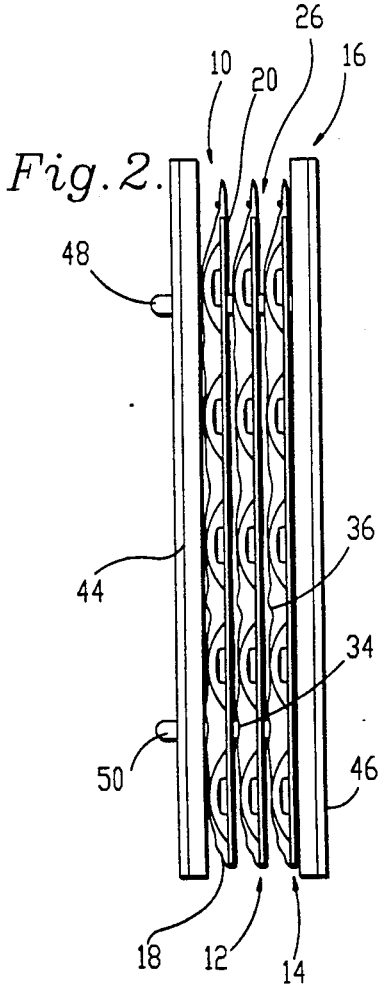
FIG. 2 is a side elevational view of a multiple bag medication book in accordance with the invention.

As shown in FIGS. 1 and 2, each of the bags 10–14 holds a multiple-dosage card 32, 34 or 36 therein. Each of the cards is identical and includes a plurality of individual, frangible, substantially transparent, single dosage form-holding compartments 38, with each of the latter including a single tablet, capsule or other dosage form 40 therein. As shown in FIG. I, the dosage forms 40 can be individually removed from the card 32, by simply breaking the respective compartments 38 and removing the medication. Such broken compartments are illustrated at 42 for example.

Referring specifically to FIG. 2, it will be seen that the book 16 includes a pair of rigid synthetic resin covers 44 and 46, with pins 48 and 50 extending between the covers 44, 46. The pins 48, 50 moreover pass through the apertures 28 of each of the bags 10–14, in order to firmly hold the latter between the covers. At least the front cover 44 is openable in a hinged fashion, so as to permit access to the bags 10–14; this front cover may also include a pocket for receipt of an inventory control record. Each of the bags 10–14 may also be turned, much in the manner of book pages, so as to successively expose the different bags for viewing.

The overall apparatus of the invention also includes an inventory control record sheet 52 which is used in conjunction with book 16. As illustrated, this sheet or "Daily Drug Record" includes markings 54 thereon referencing each of the medication and dosage forms contained within book 16 and corresponding to the information 25 on each of the bags, and has spaces 56 associated with each medication reference for noting the periodic usage of each dosage form of the different medications. Columns are also provided for room number, patient and medication administering nurse. Thus, it will readily be appreciated that the reference on sheet 52 to "Drug A 15" refers to the indicia 25 provided with bag 10, i.e., Drug A, 15 mg dosage form.

In the use of the described apparatus, a plurality of different medications are maintained in individual dosage forms within separate, individually openable bags, such as bags 10-14 (it being understood that any desired number of bags and complete books may be provided, depending upon the number of medications and dosage forms to be inventory controlled). One or more multiple-dosage cards corresponding to the identifying indicia on each bag are placed within the bag and the locking mechanism 26 is used to seal the medication cards therein. As each of the medications is required, the corresponding bag is opened, the card(s) are removed therefrom, the number of individual dosage forms is taken from the card(s), and the card(s) are put back into the associated bag.

As the dosage forms are thus taken from the individual bags, a notation thereof is made upon sheet 52, and particularly in the spaces 56 associated with the appropriate medication and dosage form reference 54.

At the end of a nursing shift or otherwise as desired, the individual dosage forms of each medication are periodically counted. This is done by viewing, through each corresponding bag and the transparent single dosage compartments of the multiple-dosage cards therein, the number of individual dosage forms remaining in each bag. As explained previously, this is a simple matter of viewing each bag and then turning the bag to expose the next underlying bag for counting purposes, until all bags are viewed and the medication therein counted.

The final step for each periodic counting is the correlation of the counted number of each of the individual dosage forms of each different medication with the inventory control record. In this fashion, a ready accounting can be made of the usage of each individual dosage form of each medication.

Although in preferred forms completely transparent bags 10–14 are employed, those skilled in the art will appreciate that it is necessary only to provide a transparent viewing panel for each bag. Similarly, while the medication and dosage form information may be directly applied to the outer margin 24 of each bag, such could also be provided by stapling or otherwise affixing a separate tag to an appropriate bag margin.

If desired, the entire book 16 may be conveniently secured in a drawer or cabinet by means of a chain affixed to the drawer or cabinet and attached to one of the covers of the book. In this fashion, additional drug security is established.

I claim:

1. Apparatus for dispensing and maintaining inventory control for a plurality of different medications in individual dosage forms, said apparatus comprising:.

a plurality of selectively openable bags each presenting a transparent viewing panel;

a multiple-dosage card presenting a plurality of frangible, substantially. transparent, single dosage form-holding compartments therein, each of said compartments containing a single dosage form of a selected medication, each of said bags holding at least one of a corresponding multiple-dosage card for a selected medication;

means for releasably interconnecting a plurality of said multiple-dosage card-holding bags along a common marginal edge of the bags; and an inventory control record sheet including markings thereon referencing each of the dosage forms of said different medications, and spaces associated with each medication reference for noting periodic usage of each dosage form of the different medications.

2. The apparatus of claim 1, each of said bags being formed of interconnected, transparent front and rear panels.

3. The apparatus of claim 1 including indicia-bearing means affixed to each of said bags for permitting marking of each bag with individual dosage form and medication information corresponding to the medication and dosage form within the bag.

4. The apparatus of claim 1 each of said bags including a releasable locking mechanism.

* * * * *